US010605151B2

(12) United States Patent
Gonze et al.

(10) Patent No.: US 10,605,151 B2
(45) Date of Patent: Mar. 31, 2020

(54) ELECTRIC PUMP OPERATING STRATEGY

(71) Applicant: GM Global Technology Operations LLC, Detroit, MI (US)

(72) Inventors: Eugene V. Gonze, Pinckney, MI (US); Sergio Quelhas, Ann Arbor, MI (US); Vijay A. Ramappan, Novi, MI (US); Michael J. Paratore, Jr., Howell, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 183 days.

(21) Appl. No.: 15/178,128

(22) Filed: Jun. 9, 2016

(65) Prior Publication Data

US 2017/0356327 A1 Dec. 14, 2017

(51) Int. Cl.
*F01P 7/16* (2006.01)

(52) U.S. Cl.
CPC ..... *F01P 7/16* (2013.01)

(58) Field of Classification Search
CPC ..... F01P 7/16
See application file for complete search history.

(56) References Cited

U.S. PATENT DOCUMENTS 6,244,831 B1 * 6/2001 Kawabata ..... F04B 49/002 417/213
6,374,780 B1 * 4/2002 Rutyna ..... F01P 7/048 123/41.12
7,267,086 B2 * 9/2007 Allen ..... F01P 7/048 123/41.44
2003/0150406 A1 * 8/2003 Takagi ..... F01P 7/167 123/41.1
2004/0011304 A1 * 1/2004 Herynek ..... F01P 7/164 123/41.1
2012/0168118 A1 * 7/2012 Myers ..... F01P 5/10 165/51
2013/0305708 A1 * 11/2013 Zahdeh ..... F01P 3/20 60/599
2013/0340721 A1 * 12/2013 Suda ..... F02D 41/221 123/496

(Continued)

FOREIGN PATENT DOCUMENTS

CN 104727927 A 6/2015

*Primary Examiner* — Joseph J Dallo
*Assistant Examiner* — Kurt Philip Liethen

(57) ABSTRACT

A strategy for controlling an electric pump and control valve in an internal combustion engine cooling system compensates for backpressure variations and maintains system operation within design parameters. The method comprises the steps of measuring the coolant temperature, measuring the electrical current and voltage to the pump motor, determining the pump speed and coolant flow, determining the desired coolant flow, determining a negative correction to the flow control valve and pump if desired flow is less than present coolant flow and determining a positive correction to the flow control valve and pump if desired flow is more than present coolant flow and undertaking this correction to coolant flow. Thus, based upon inferred back pressure in the engine coolant system from the data relating to the pump energy input, proper coolant flow, heat rejection and engine operating temperature can be maintained in spite of variations in system flow restrictions and backpressure.

12 Claims, 2 Drawing Sheets

(56) References Cited

U.S. PATENT DOCUMENTS

| | | | | |
|---|---|---|---|---|
| 2014/0343821 | A1* | 11/2014 | Kim | F01P 11/18<br>701/101 |
| 2015/0047340 | A1* | 2/2015 | Ulrey | F02B 47/08<br>60/600 |
| 2017/0030274 | A1* | 2/2017 | Nakanishi | F01P 7/16 |
| 2018/0066758 | A1* | 3/2018 | Yumisashi | F01P 7/14 |

* cited by examiner

ELECTRIC PUMP OPERATING STRATEGY

FIELD

The present disclosure relates to electric pumps utilized in internal combustion engine coolant circuits and more particularly to a strategy for controlling an electrically powered pump in an internal combustion engine coolant circuit.

BACKGROUND

The statements in this section merely provide background information related to the present disclosure and may or may not constitute prior art.

The cooling circuit of an internal combustion engine and more particularly coolant flow in the cooling circuit of an internal combustion engine in a motor vehicle is critical not only from the fundamental standpoint of dissipating the heat of combustion to the ambient but also to accurately control the temperature of the engine to optimize performance and fuel economy.

Significant engineering and design effort is directed to these operational parameters, especially the latter given increasingly stringent fuel economy requirements. Unfortunately, even the most sophisticated cooling system configurations are subject to variations caused by, for example, manufacturing and assembly variables and wear and aging of the components such as the pump impeller, the radiator and the hoses. These variations cause variations in system backpressure which can result in flow reduction and temperature variations that deviate from design goals.

With older engines having engine driven coolant pumps (and less stringent performance expectations and requirements) such backpressure variations were of little moment. Today, an increasing number of internal combustion engines, obviously subject to today's performance expectations and requirements, utilize electrically driven coolant pumps, which, unfortunately, are highly sensitive to backpressure variations. A engine cooling system utilizing an electric pump that initially met all heat dissipation and temperature control requirements, as components wear and age and system backpressure changes, may no longer achieve the desired design goals. Because coolant flow and thus temperature and heat dissipation affect cylinder wall and cylinder head temperature, an engine operating at other than design or optimal temperature will compromise fuel economy.

The present invention addresses this problem.

SUMMARY

The present invention provides a strategy for controlling an electric pump in an internal combustion cooling circuit or system which compensates for backpressure variations and maintains system operation, especially engine temperature, within design parameters. The method of operation comprises the steps of measuring the coolant temperature, measuring the electrical voltage and current to the electric pump, determining the pump speed and the coolant flow, determining the desired coolant flow, determining a positive correction signal to the flow control valve and electric pump motor if desired flow is less than current coolant flow and determining a negative correction signal to the flow control valve and electric pump motor if desired flow is more than current coolant flow and undertaking this correction to coolant flow. Thus, based upon inferred back pressure in an engine coolant circuit from the data, engine operating temperature can be maintained in spite of short term and long term variations in system flow restrictions and backpressure and thus variations in coolant flow.

It is thus an aspect of the present invention to provide a control method for a cooling system or circuit of an internal combustion engine which compensates for variations in flow restrictions.

It is a further aspect of the present invention to provide a control method for a cooling system or circuit of an internal combustion engine which measures electric coolant pump voltage and current to determine pump speed and flow.

It is a still further aspect of the present invention to provide a control method for a cooling system or circuit of an internal combustion engine which infers system or circuit backpressure from electric pump operational date.

It is a still further aspect of the present invention to provide a control method for a cooling system or circuit of an internal combustion engine which provides a positive correction signal to the flow control valve and electric pump motor if instantaneous coolant flow is less than desired coolant flow.

It is a still further aspect of the present invention to provide a control method for a cooling system or circuit of an internal combustion engine which provides a negative correction signal to the flow control valve if instantaneous coolant flow is more than desired coolant flow.

It is a still further aspect of the present invention to provide a control method for a cooling system or circuit of an internal combustion engine which compensates for variations in system backpressure thereby maintaining design engine operating temperature and other parameters.

It is a still further aspect of the present invention to provide a control method for a cooling system or circuit of an internal combustion engine which compensates for short term and long term variations in system backpressure thereby maintaining design engine operating parameters such as temperature.

Further aspects, advantages and areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 1:
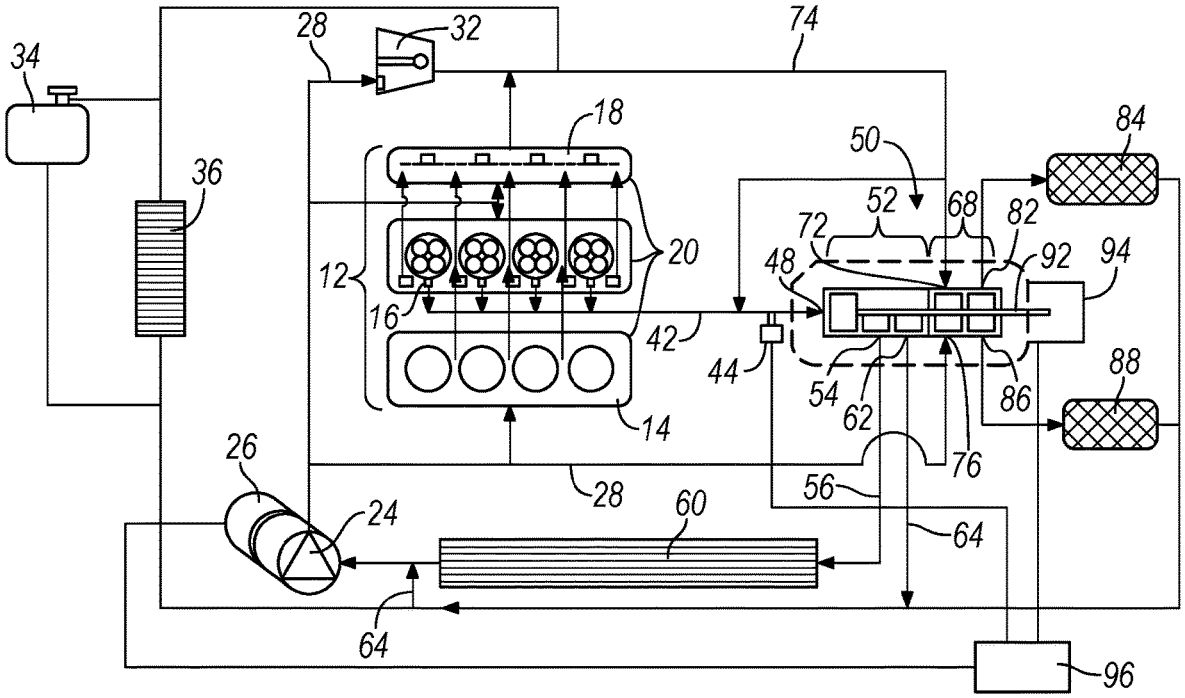
FIG. 1 is a schematic diagram of an internal combustion coolant system or circuit incorporating the present invention.
Figure 3:
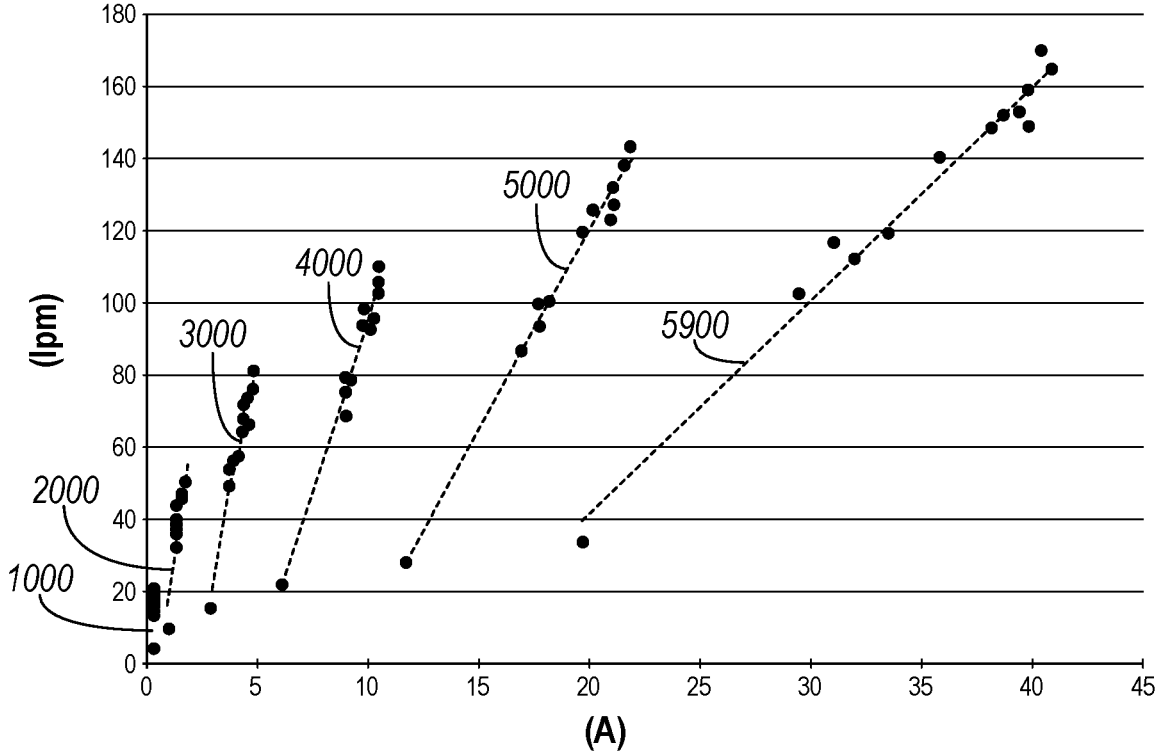
Figure 4:
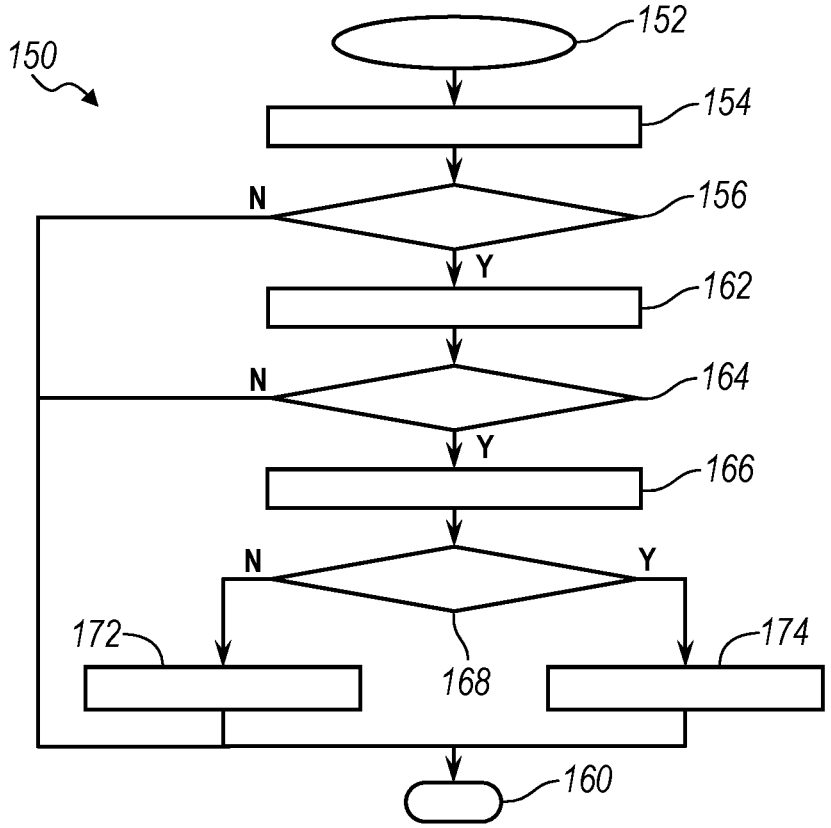

FIG. 3 is a graph presenting current to the electric pump of FIG. 1 on the X (horizontal) axis versus pump flow in liters per minute in the Y (vertical axis) for several speed (r.p.m.) conditions of the electric pump between 1000 r.p.m. and 5900 r.p.m.; and FIG. 4 is a flow chart of the method of operating an internal combustion engine cooling system or circuit having an electrically driven coolant pump according to the present invention.

DETAILED DESCRIPTION

The following description is merely exemplary in nature and is not intended to limit the present disclosure, application, or uses.

With reference to FIG. 1, an internal combustion engine and cooling system or circuit is illustrated and generally designated by the reference number 10. The engine and cooling system 10 includes an internal combustion engine 12 having an engine block 14 including cylinders and pistons, a head 16 including valves and an integrated exhaust manifold 18. These components of the internal combustion engine 12 are surrounded by a cooling jacket 20 through which a liquid coolant is circulated by a coolant pump 24. The coolant pump 24 is driven by an electric motor 26. From the coolant pump 24, the liquid coolant is circulated in a coolant supply line 28 to the components of the internal combustion engine 12, a turbocharger 32, a surge tank 34 and a heater core 36.

The coolant passing through the components of the internal combustion engine 12 exits in a coolant line 42 which includes an engine outlet temperature sensor 44. The coolant then enters a first inlet port 48 of a two section coolant control valve 50. A first section 52 of the coolant control valve 50 receives coolant flow from the internal combustion engine 12 through the first inlet port 48 and directs it to either a first exhaust port 54 connected through a line 56 to a radiator 60 or a second (bypass) exhaust port 62 connected to a line 64 which bypasses the radiator 60 and returns coolant to the inlet or suction side of the coolant pump 24.

A second section 68 of the coolant control valve 50 receives coolant flow in a second inlet port 72 from both the integrated exhaust manifold 18 and the turbocharger 32 in a line 74 which also communicates with the inlet port 48 of the first section 52 of the coolant control valve 50. A third inlet port 76 of the second section 68 of the coolant control valve 50 is connected to the coolant pump 24 through the fluid supply line 28. The second section 68 of the coolant control valve 50 also includes two exhaust ports: a third exhaust port 82 which directs coolant flow to an engine oil heater 84 and a fourth exhaust port 86 which directs coolant flow to a transmission oil heater 88. Return coolant flows from the engine oil heater 84 and the transmission oil heater 88 are carried in the line 64 which communicates with the inlet or suction side of the coolant pump 24. The coolant control valve 50 also includes a single, i.e., tandem, spool or flow control element 92 which is linearly and bi-directionally translated by an electric or hydraulic actuator or operator 94.

Both the electric motor 26 of the coolant pump 24 and the linear actuator or operator 94 of the coolant control valve 50 are under the control of an engine control module (ECM) 96 or other, similar global or dedicated electronic control module have I/O devices, static and transient memories and processors or microprocessors as well as associated electronic components.

Figure 2:
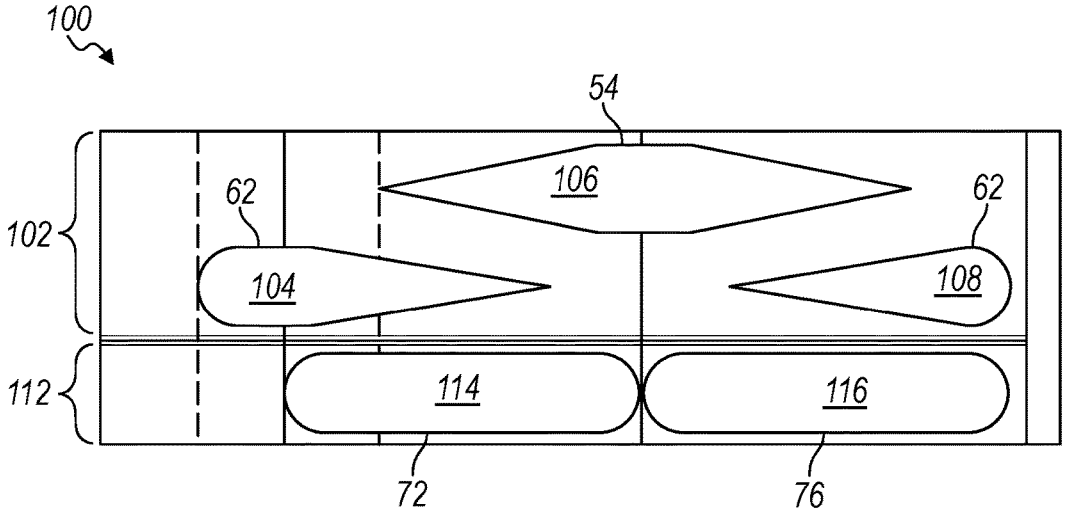
FIG. 2 is a diagrammatic map of control valve spool position versus flows of the coolant control valve illustrated in FIG. 1.

Turning now to FIGS. 1 and 2, a diagrammatic map of the position of the spool or flow control element 94 of the coolant control valve 50 is illustrated and designed by the reference number 100. The upper portion 102 of the map 100 relates to the first section 52 of the coolant control valve 50 and the lower portion 112 relates to the second section 68 of the coolant control valve 50. While the map 100 presents two portions 102 and 112 relating specifically to the two respective sections 52 and 68 of the coolant control valve 50, it should be understood that since there is but a single linear operator 94 and a single (tandem) spool or flow control element 92, the action of one section relative to the other is always the same. Stated somewhat differently, at any given position of the spool or flow control element 92, the actions or flow control conditions of the two section 52 and 68 will always be the same.

Turning next to the upper portion 102 of the map 100, as noted, it relates to the first section 52 of the coolant control valve 50. At the full left position of travel of the spool or flow control element 92, all of the coolant flow is directed to the second (bypass) exhaust port 62 connected to the line 64 as indicated by the area 104. As the spool 92 translates to the right, flow through the (bypass) second exhaust port 62 decreases while flow through the first exhaust port 54 connected through a line 56 to the radiator 60 increases. The latter flow is represented by the area 106. At approximately the mid or center position of the spool or flow control element 92 all coolant flow from the first inlet port 48 of the first section 52 of the coolant control valve 50 is directed to the radiator 60. As the spool or flow control element 92 continues to translate to the right, flow through the first inlet port 48 and the radiator 60 begins to decrease while flow through the second (bypass) exhaust port 62 and the line 64 begins to increase, as represented by the area 108, until the limit of travel to the right is reached and all coolant flow bypasses the radiator 60 and flows through the second exhaust port and the line 64.

Referring now to the lower portion 112 of the map 100, it will be appreciated that for a short distance of travel of the spool or flow control element 92 neither of the inlet ports 72 and 76 are open. After this region, the second inlet port 72 from the integrated exhaust manifold 18 and the turbocharger 32 opens rapidly, represented by the area 114, and stays open until the center point of the region or area 106 in the upper portion 102 is reached. At this center point, the second inlet port 72 is closed and the third inlet port 76 connected by the supply line 28 to the electric pump 24 is opened as represented by the area 116. This condition persists for the remainder of translation to the right of the spool or flow control element 92. When opened, the flows from the second inlet port 72 and the third inlet port 76 are provided to both the engine oil heater 84 and the transmission oil heater 88.

With reference now to FIG. 3, a graph presents current in amps (A) to the electric motor 26 of the pump 24 of FIG. 1 on the X axis versus pump flow in liters per minute (lpm) in the Y axis for several speed (r.p.m.) conditions of the electrically powered pump 24 between 1000 r.p.m. and 5900 r.p.m., which are labelled from left to right 1000, 2000, 3000, 4000, 5000, and 5900. Note that at the slower pump speeds, particularly 1000 r.p.m. to 3000 r.p.m., the locus of points is nearly vertical meaning that the relationship between pump current and flow cannot be utilized to accurately infer pump flow from current draw and voltage. Contrariwise, at the higher speeds, such as 5000 and 5900 r.p.m., the slope of the locus of points provides a readily utilized and accurate relationship between current flow and pump flow. The ability to accurately infer pump flow (output) from current flow is an important aspect of the present invention, and as FIG. 3 illustrates, is most reliable and accurate when the electric motor 26 and the pump 24 are rotating at speeds above 4000 r.p.m. and preferably 5000 r.p.m. or higher.

Turning now to FIGS. 1 and 4, a flow chart of a program, sub-routine or flowchart of the method of operating an electrically driven pump and control valve such as the pump 24 in an internal combustion engine cooling system or circuit 10 is illustrated and designated by the reference number 150. Preferably, the program or sub-routine embodying the method 150 may be contained within the control module 96 or a similar electronic device. The program or method 150 begins with a start or initializing step 152 of a continuous loop program and moves to a process step 154 which reads the current or instantaneous coolant temperature from the engine outlet temperature sensor 44. Next, a decision point 156 is encountered which determines whether the current coolant temperature is at or above a predetermined or design threshold temperature. This temperature will typically be engine and application specific. If the current temperature is below the predetermined threshold temperature, the decision point 156 is exited at NO and the method 150 terminates at a stop or exit step 160 and repeats, as noted, in a continuous loop. If the current temperature is at or above the predetermined threshold temperature sensed in the process step 154, the decision point 156 is exited at YES and the method moves to a process step 162 which infers from the current draw or senses or reads the present speed (r.p.m.) of the electric motor 26 of the coolant pump 24.

A decision point 164 is then encountered which determines whether the speed of the electric motor 26 is at or above a predetermined or design threshold value. If the speed of the electric motor 26 is below the predetermined or design threshold, the decision point 164 is exited at NO and the method 150 terminates at the stop or exit step 160 and repeats. If the speed of the electric motor 26 is at or above the predetermined or design threshold, the decision point 164 is exited at YES and the method 150 moves to a process step 166. It should be appreciated that optimum control is achieved by the present method 150, utilizing current sensing to infer motor speed, when the speed of the electric motor 26 and the pump 24 is at least 4000 r.p.m. and preferably 5000 r.p.m. or higher, as noted above, which is the optimal pump accuracy range.

The process step 166 then determines the pump output or coolant flow which is a function of the speed (r.p.m.) of the pump 24, the electric current drawn or consumed by the electric motor 26 driving the pump 24, the voltage supplied to the electric motor 26. From this data, and utilizing an application specific look up table or similar computational or memory device or application, the present coolant flow is determined. The position of the coolant control valve 50 is also monitored by the control module 96 which may be achieved without feedback by reading the signal provided to the linear actuator or operator 94 or may be provided by feedback from a linear sensor (not illustrated) associated with the actuator or operator 94.

Next, in a decision point 168, the desired coolant flow is compared to the present coolant flow. The desired coolant flow is found in, for example, a look up table or read only memory which is engine specific and based upon prior dynamometer tests. The primary factors utilized to determine the desired coolant flow are engine speed, engine temperature and engine mode as well as other, optional, secondary factors. If the desired coolant flow is less than the present coolant flow such that more heat is being transported out of the engine 12 and its temperature is lower than is optimal, the decision point 168 is exited at NO and the method 150 moves to a process step 172. If the desired coolant flow is greater than the present coolant flow such that less heat is being transported out of the engine 12 and its temperature is higher than is optimal, the decision point 168 is exited at YES and the method 150 moves to a process step 174.

Since the process step 172 is executed when, in the decision point 168, it is determined that the desired coolant flow is less than the present coolant flow and the process step 174 is executed when, in the decision point 168, it is determined that the desired coolant flow is greater than the present coolant flow, it should be appreciated that the two process steps 172 and 174 provide closed loop feedback in opposite directions: the former (172) reducing the coolant flow to the desired level or rate and the latter (174) increasing the coolant flow to the desired level or rate.

Turning first to the process step 172, a flow correction factor $F_C$ is computed which is the difference between the desired and currently measured coolant flow. A flow learn value $F_L$ which represents all previous corrections as a function of coolant valve position is also computed. Then, a flow multiplier $F_M$ which is a correction factor for coolant backpressure based on present coolant valve position is computed by subtracting the flow correction factor $F_C$ from the flow learn value $F_L$. The corrected or new pump flow is then computed as the open loop (unrestricted) pump flow times the just computed flow multiplier $F_M$. The computed corrected pump flow signal is then provided to the coolant control valve 50 by the control module 96 to adjust its position and to the electric motor 26 of the coolant pump 24 to provide an appropriate reduction in the coolant flow. The method ends at the stop or exit step 160 and then repeats.

Similar though inverse activity occurs in the process step 174 wherein a flow correction factor $F_C$ is computed which is the difference between the desired and currently measured coolant flow. The flow learn value $F_L$ which represents all previous corrections as a function of coolant valve position is also computed. Then, a flow multiplier $F_M$ which is a correction factor for coolant backpressure based on present coolant valve position is computed by adding the flow correction factor $F_C$ to the flow learn value $F_L$. The corrected or new pump flow is then the open loop (unrestricted) pump flow times the just computed flow multiplier $F_M$. The computed corrected or new pump flow is then provided to the coolant control valve 50 by the control module 96 to adjust its position and to the electric motor 26 of the coolant pump 24 to provide an appropriate increase in the coolant flow. The method ends at the stop or exit step 160 and then repeats.

It will thus be appreciated that an internal combustion engine cooling system of circuit having an electrically driven pump and coolant control valve which is operated according to the just described method is capable of not only matching coolant flow to varying operating conditions of the engine such as speed and ambient temperature but is also capable of compensating for short and long term variations in system backpressure that would otherwise interfere with attaining and maintaining optimal system operating temperatures.

The description of the invention is merely exemplary in nature and variations that do not depart from the gist of the invention are intended to be within the scope of the invention. Such variations are not to be regarded as a departure from the spirit and scope of the invention.

What is claimed is:

1. A method of operating an electrically driven coolant pump for an internal combustion engine, comprising the steps of:

measuring a coolant temperature in an engine cooling circuit of said internal combustion engine, providing a coolant pump in said engine cooling circuit driven by an electric pump motor, measuring at least electrical current to said electric pump motor and determining a speed of said electric pump motor, determining a coolant flow provided by said coolant pump from said speed of said electric pump motor, providing a coolant control valve in said engine cooling circuit, said coolant control valve defining a first section and a second section isolated from said first section, said first section receiving coolant from said internal combustion engine and directing said coolant to a radiator or to bypass said radiator and said second section receiving coolant from a turbocharger and said coolant pump and directing said coolant to an engine oil heater and a transmission oil heater, determining a negative correction if desired flow is less than said determined coolant flow by subtracting a flow correction value from a flow learn value and multiplying such result by an open loop pump flow value and providing said negative correction to said coolant control valve and said electric pump motor to reduce coolant flow and determining a positive correction if desired flow is more than said determined coolant flow by subtracting a flow correction value from a flow learn value and multiplying such result by an open loop pump flow value and providing said positive correction to said coolant control valve and said electric pump motor to increase coolant flow.

2. The method of operating an electrically driven coolant pump of claim 1 including the step of undertaking no further steps if said measured coolant temperature is below a predetermined threshold temperature.

3. The method of operating an electrically driven coolant pump of claim 1 including the step of undertaking no further steps if said determined speed of said electric motor is below a predetermined threshold speed.

4. The method of operating an electrically driven coolant pump of claim 1 wherein said coolant control valve defines a first end position of said first section wherein all of said coolant bypasses said radiator, an intermediate position wherein all of said coolant is directed to said radiator and a second end position wherein all of said coolant bypasses said radiator, and a first end position of said second section achieved together with said first end position of said first section directs said coolant from said turbocharger to said engine oil heater and said transmission oil heater and a second end position of said second section achieved together with said second end position of said first section directs said coolant from said coolant pump to said engine oil heater and said transmission oil heater.

5. The method of operating an electrically driven coolant pump of claim 1 further including the step of providing an electronic control module and providing said temperature and electrical measurements to said control module.

6. The method of operating an electrically driven coolant pump of claim 1 wherein said flow correction value is a difference between a desired coolant flow and said currently determined coolant flow and said flow learn value represents all previous corrections as a function of positions of said coolant control valve.

7. A method of controlling an electrically driven coolant pump for an internal combustion engine, comprising the steps of:

providing an electronic control module, measuring a coolant temperature in an engine cooling circuit for said internal combustion engine and providing said measurement to said electronic control module, providing a coolant pump in said engine cooling circuit driven by an electric motor, measuring electrical current and voltage to said electric pump motor and providing said electrical measurements to said electronic control module, determining a speed of said electric pump motor in said electronic control module, determining a coolant flow provided by said coolant pump from said speed of said electric pump motor, providing a coolant control valve in said engine cooling circuit, said coolant control valve defining a first section and a second section isolated from said first section, said first section receiving coolant from said internal combustion engine and directing said coolant to a radiator or to bypass said radiator and said second section receiving coolant from a turbocharger and said coolant pump and directing said coolant to an engine oil heater and a transmission oil heater, determining a negative correction signal if desired flow is less than said determined coolant flow by subtracting a flow correction value from a flow learn value and multiplying a result by an open loop pump flow value and providing said negative correction signal to said coolant control valve and said electric pump motor from said electronic control module and determining a positive correction signal if desired flow is more than said determined coolant flow by subtracting a flow correction value from a flow learn value and multiplying a result by an open loop pump flow value and providing said positive correction signal to said coolant control valve and said electric pump motor from said electronic control module.

8. The method of operating an electrically driven coolant pump of claim 7 wherein said coolant control valve defines a first end position of said first section wherein all of said coolant bypasses said radiator, an intermediate position wherein all of said coolant is directed to said radiator and a second end position wherein all of said coolant bypasses said radiator, and a first end position of said second section achieved together with said first end position of said first section directs said coolant from said turbocharger to said engine oil heater and said transmission oil heater and a second end position of said second section achieved together with said second end position of said first section directs said coolant from said coolant pump to said engine oil heater and said transmission oil heater.

9. The method of controlling an electrically driven coolant pump of claim 7 including the step of terminating said method if said measured coolant temperature is below a predetermined threshold temperature.

10. The method of controlling an electrically driven coolant pump of claim 7 including the step of terminating said method if said determined speed of said electric motor is below a predetermined threshold speed.

11. The method of controlling an electrically driven coolant pump of claim 7 wherein said positive correction signal and said negative correction signal are also provided to said electric motor of said coolant pump.

12. The method of controlling an electrically driven coolant pump of claim 7 wherein said flow correction value is a difference between a desired coolant flow and said currently determined coolant flow and said flow learn value represents all previous corrections as a function of positions of said coolant control valve.

* * * * *